US008492632B1

(12) United States Patent
Doe

(10) Patent No.: US 8,492,632 B1
(45) Date of Patent: Jul. 23, 2013

(54) TUNED BELL HARMONIC MUSICAL INSTRUMENT

(76) Inventor: Grahm Doe, Oakhurst, CA (US)

( * ) Notice: Subject to any disclaimer, the term of this patent is extended or adjusted under 35 U.S.C. 154(b) by 230 days.

(21) Appl. No.: 13/065,722

(22) Filed: Mar. 30, 2011

(51) Int. Cl.
*G10D 13/08* (2006.01)

(52) U.S. Cl.
USPC ..... 84/406

(58) Field of Classification Search
USPC ..... 84/406
See application file for complete search history.

(56) References Cited

U.S. PATENT DOCUMENTS

| | | | | | |
|---|---|---|---|---|---|
| D31,888 | S | * | 11/1899 | Rockwell | D10/121 |
| 2,800,870 | A | * | 7/1957 | Garthwait, Jr. | 116/155 |
| 4,436,052 | A | * | 3/1984 | Schall | 116/148 |
| 8,299,343 | B2 | * | 10/2012 | Copeland | 84/411 R |

* cited by examiner

*Primary Examiner* — Jianchun Qin
(74) *Attorney, Agent, or Firm* — Paul R. Martin

(57) ABSTRACT

Disclosed is a tuned harmonic bell musical instrument. The harmonic bell consists of a thin walled circular base, and a contiguous dome. The base is open at the bottom. The dome has a plurality of tongues cut into the surface thereof, thereby enabling notes with bell like harmonics to be generated when the tongues are struck with a mallet or other device.

15 Claims, 6 Drawing Sheets

TUNED BELL HARMONIC MUSICAL INSTRUMENT

BACKGROUND OF THE INVENTION

1. Field of the Invention

The present invention relates to a musical instrument. More particularly, it relates to a musical instrument which may be described as a tuned bell harmonic musical instrument. Still more specifically, the invention relates to a tuned bell harmonic musical instrument that has a plurality of vibrating tongues in the dome of the bell that causes various notes and harmonics to be generated when the tongues or bell are struck with a stick, a mallet or similar device.

2. Description of the Related Art

Bells and singing bowls are well known in the art. See, for example, the discussion of singing bowls in the Wickipedia encyclopedia on the Internet. i.e. the discussion presented in www.en.wikipedia.org/Singing_Bowl. Bells and singing bowls typically have a tuned low fundamental note emanating from the lip or rim of the bell. Higher frequency supporting harmonic tones in the octaves, 2nds, 3rds, $4^{th}$, and $5^{th}$ are used to add a more musical tone to the bell. These naturally occurring higher supporting harmonics are created by faster vibrations in the middle and top regions of the bell. Controlling the strength and tuning of these harmonics is very difficult to do. Typically this is done with changes to metal composition, thickness, bell length, width and profile. Adjusting one area can affect the tones in other areas making for a complicated and labor intensive process. Once a shape is finalized, the bell is typically cast in bronze. This is an expensive process.

Another method of creating musical tones is with vibrating tongues. If a long three sided rectangular shaped tongue is cut out of sheet steel, for example, it can be struck toward the tip and will vibrate creating a musical tone. The size of the tongue can be made smaller to produce higher tones, and larger to produce lower tones. The thickness, composition, shape and annealing of the metal being used will produce a range of notes possible.

Musical instruments with tongues are also known in the art. These are sometimes called tongue drums. Some are made of low carbon steel, and are called steel tongue drums. Such drums can be purchased from the Percussive Devices Company, www.percussivedevices.com and the Milltone company, which sells tunable steel tongue drums. Another seller of steel tongue drums is the RockCreek company, www.rockcreeksteeldrums.com. These drums are totally enclosed or come with a small opened sound port. . . When the tongues are struck, individual notes are heard. The body of the drum does not ring on its own.

The inventor can find no patent literature pertaining to steel tongue drums.

The primary disadvantage of the steel tongue drums presently on the market is that the sound that is generated by the tongues is not supported with ringing from the body of the drum, as would be the case if a bell were to be struck. The present invention is a tuned bell harmonic musical instrument that enables harmonic sounds to be achieved using tongues in the dome of the bell. The instrument is completely open at the bottom, which enables a bell tone to be achieved when tongues on the dome are struck.

BRIEF SUMMARY OF THE INVENTION

It is an object of the present invention to provide a tuned bell harmonic musical instrument with precisely tuned harmonics using low carbon steel.

It is another object of the present invention to provide a tuned bell harmonic musical instrument having tongues in the dome thereof enabling more pleasing harmonics to be achieved than is obtained with steel tongue drums of the prior art.

The invention is musical instrument having a bell configuration with vertical walls connected by an arcuate dome, wherein the dome has a plurality of tongues of varying cross sectional area defined therein, where each of the tongues, when struck, provides a melodius tone with pleasing overlying harmonics. The bottom of the instrument is open, similar to that of a bell.

The invention further comprises a pedestal based support system which enables the musical instrument to be supported on a rubber cushion so as to allow the rim of the bell to ring freely.

BRIEF DESCRIPTION OF THE SEVERAL VIEW OF THE DRAWINGS

DETAILED DESCRIPTION OF THE INVENTION

Figure 1:
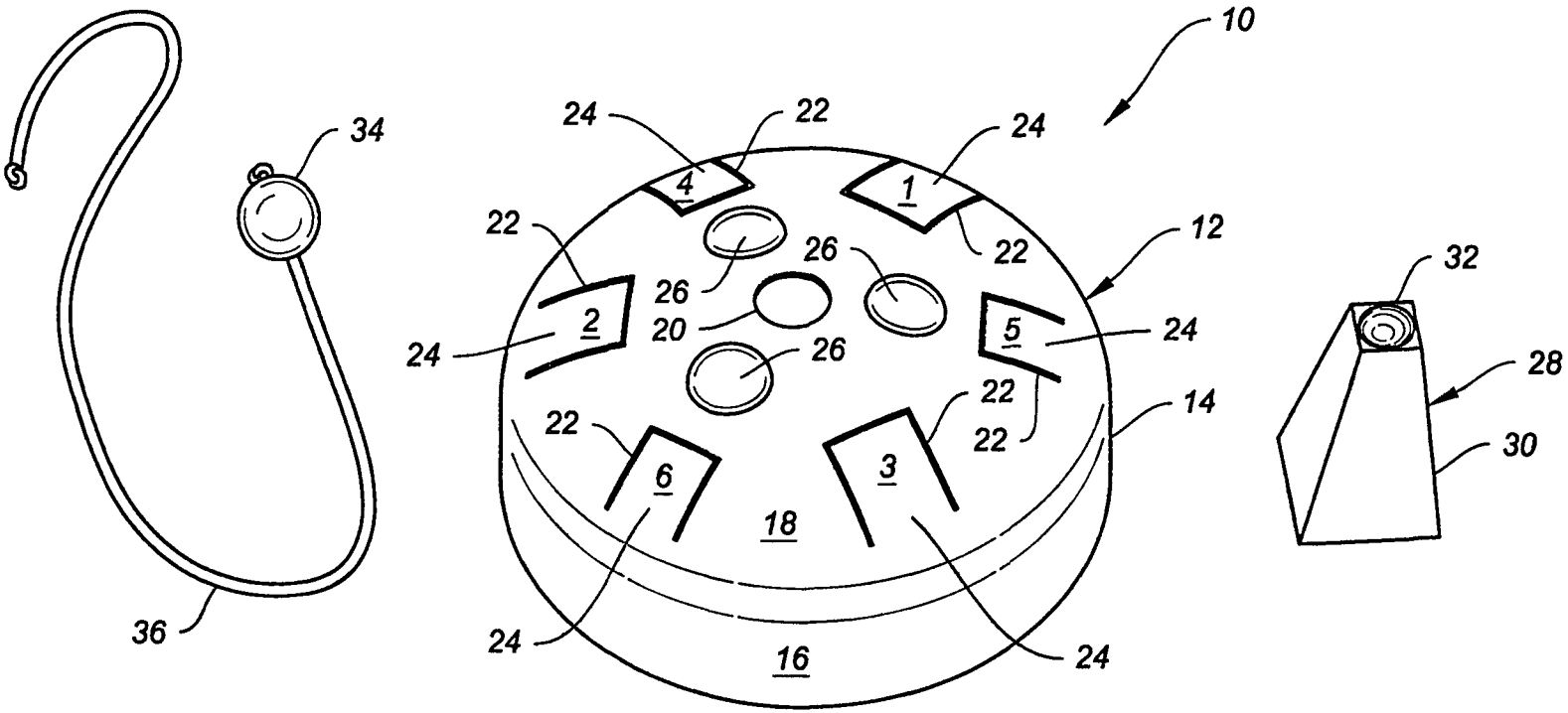
FIG. 1 is a perspective view from above of the musical instrument of this invention, and supporting system.

The tuned harmonic bell musical instrument 10 of this invention is comprised of two components. The first component, shown in FIGS. 1-4, is a tuned harmonic bell 12. The bell 12 comprises a circular base 14 with vertical walls 16, and a upwardly curved dome 18 overlying and connecting to the tops of the walls 16 of the base 14. The dome 18 has a hole 20 in the center at the top thereof. The bell 12 is open at the bottom. The bell 12 is a unitary object formed from a sheet of low carbon steel that is molded or stamped to the desired shape. Preferably, the steel is about 2 mm thick. After the bell 12 is formed, it is heat treated to relieve stress.)

A plurality of tongues 22 are cut into the dome 18. As shown, the tongues 22 are rectangular in configuration, although other shapes can be used. The base 24 of each tongue 22 is contiguous with the body of the dome 18 Each tongue 22 has a different surface area, and generates a different note when struck.

In the preferred embodiment of the invention, the base 14 has a diameter of 12 inches, and the walls 16 are 6 inches high. The dome 18 has a curvature such that the distance between the top of the dome 18, and an imaginary horizontal line running across the walls 16 at the top thereof is 2 inches. That is, the depth of the dome 18, at the center, is 2 inches, thus making the total height of the bell 8 inches. The total height can be reduced or increased to finely tune the bell note.

Figure 2:
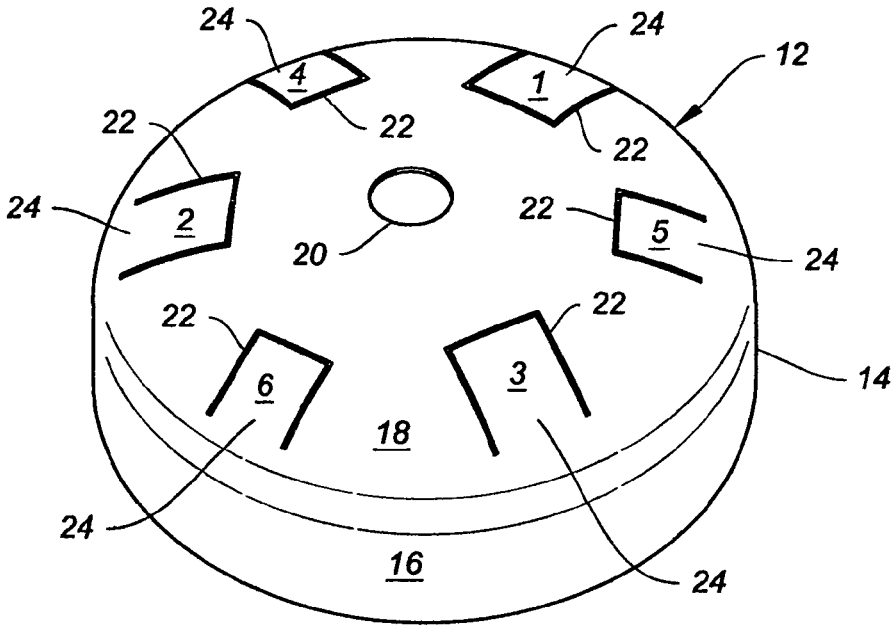
FIG. 2 is a perspective view from above of the musical instrument of this invention.
Figure 3:
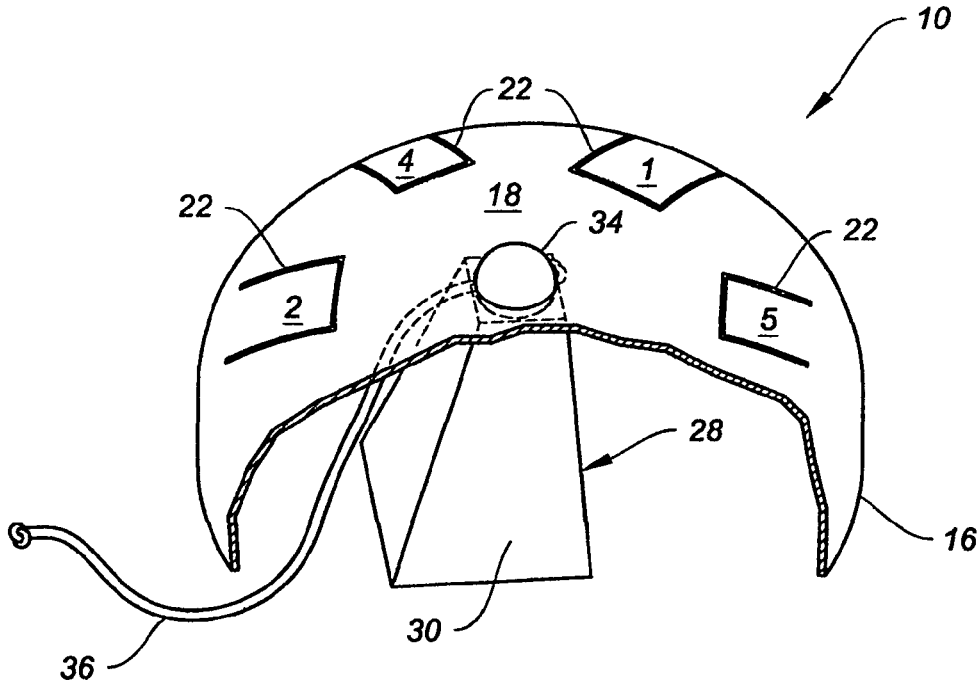
FIG. 3 is a perspective view from above of the musical instrument of this invention with portions cut away to show the support system in place supporting the instrument.

In the preferred embodiment of the invention, the dome 18 has six tongues 22 cut in it, designated 1, 2, 3, 4, 5, and 6, as shown in FIGS. 1, 2, and 3. The tongues 22 are spaced apart around the dome 18. In the preferred embodiment of the invention, tongue 1 is 6 cm×4.5 cm, having a surface area of 27 sq.cm., tongue 2 is 5.5 cm×4 cm, having a surface area of 22 sq cm, tongue 3 is 5.2 cm×4 cm, having a surface area of 20.8 sq. cm, tongue 4 is 5 cm×3.5 cm, having a surface area of 17.5 sq cm, tongue 5 is 4.2 cm×3.5 cm, having a surface area of 14.7 sq cm, and tongue 6 is 4 cm×3.5 cm, having a surface area of 14 sq cm.

Each tongue 22 will vibrate individually when struck. Each of the tongues 22 has a different surface area, thus producing different notes, and harmonics thereof when struck with a mallet. Tongue 1 produces an F note in the $4^{th}$ octave, tongue 2 produces a G note in the $4^{th}$ octave, tongue 3 produces an A note in the fourth octave, tongue 4 produces a C note in the $5^{th}$ octave, tongue 5 produces a D not in the $5^{th}$ octave, and tongue 6 produces an F note in the $5^{th}$ octave.

The tongues 22 are positioned sufficiently close together in the dome 18 so that tongues other than the one struck will also vibrate through energy transference, and produce harmonics of the struck tongue.

Figure 5:
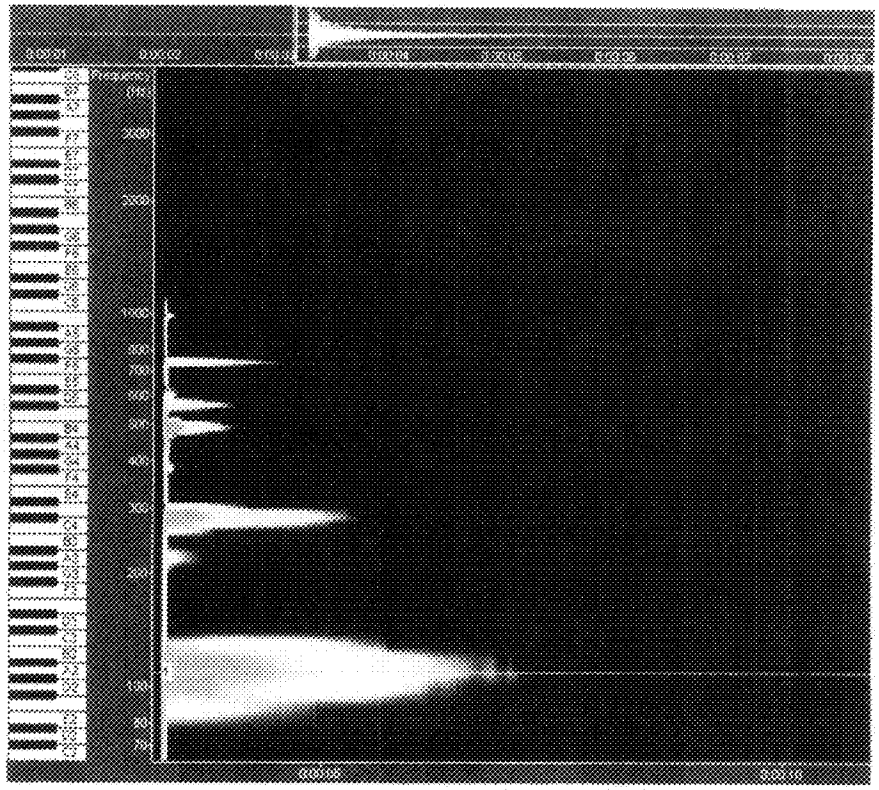
FIG. 5 is a harmonic graph showing various tones and their intensity generated when only the base of the tuned harmonic bell musical instrument of this invention is struck with a mallet.
Figure 6:
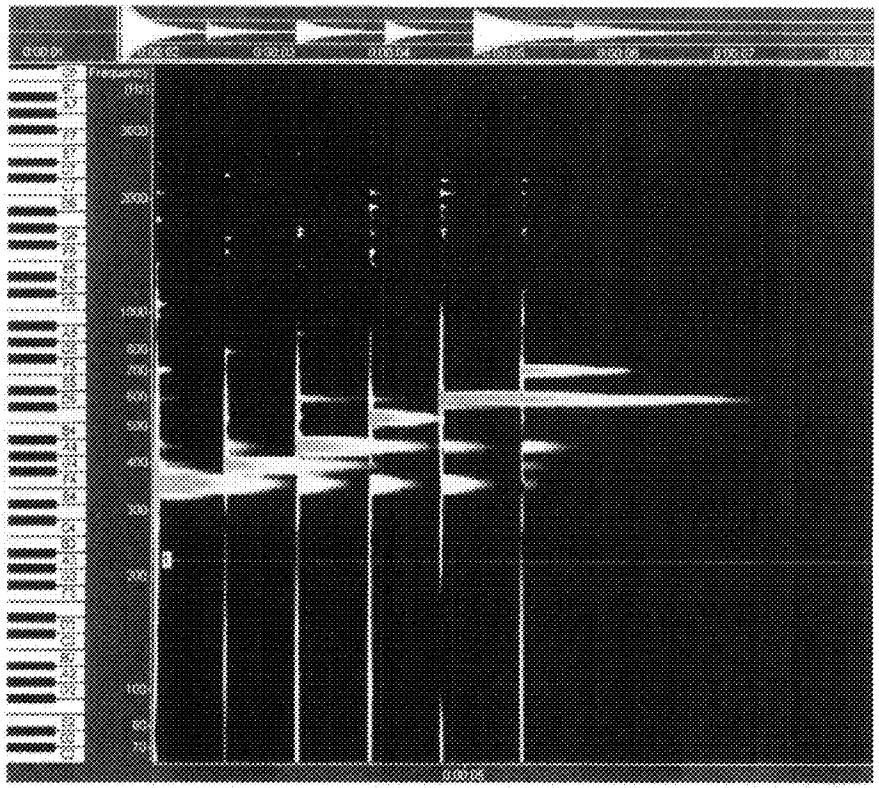
FIG. 6 is a harmonic graph showing various tones and their intensity generated when only the tongues in the dome of the tuned harmonic bell musical instrument of this invention are struck in sequence.
Figure 7:
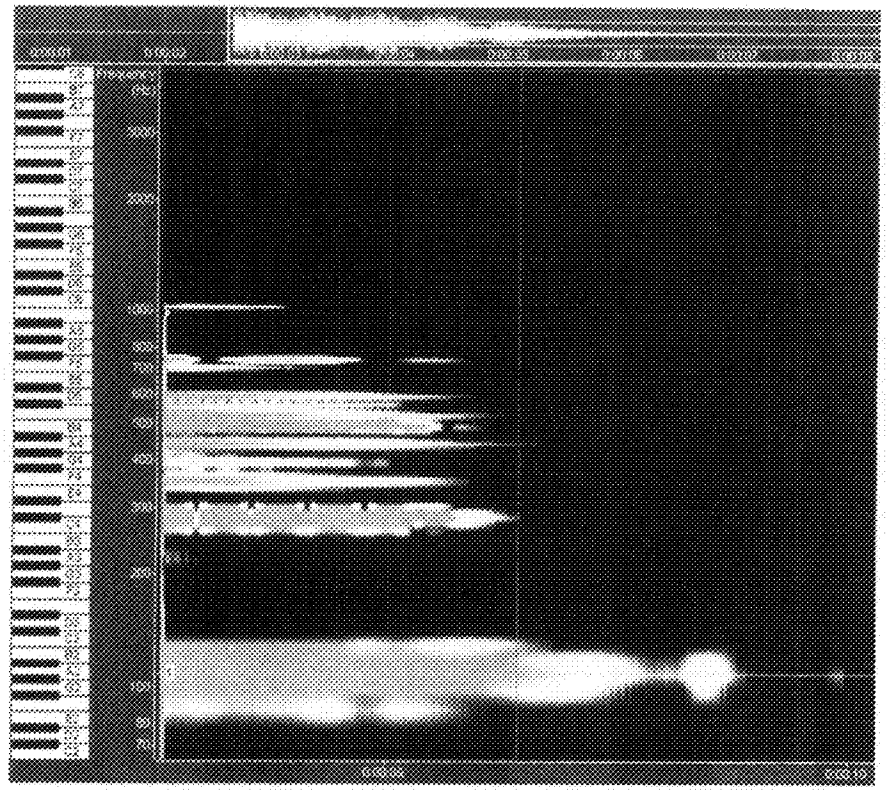
FIG. 7 is a harmonic graph showing various tones and their intensity that are generated when the base of the tuned harmonic bell musical instrument of this invention is struck, and the tongues in the dome are allowed to vibrate as the base is struck.

The novelty and uniqueness of the tuned harmonic bell of this invention is demonstrated in FIGS. 5, 6 and 7. FIG. 5 is a graph that shows a tone generated by striking the side of the preferred bell 12 described above with a mallet. The main note generated is A2, that is, the note A in the second octave, and some additional harmonic sounds. The sounds were analyzed by first picking up the sounds with a microphone, then transferring the sounds to a computer upon which sound analyzing software, http://www.sygyt.com/en/overtone-analyzer, was installed. The tongues 22 in the dome 18 of the bell were taped over to prevent them from vibrating and showing up on the graph. FIG. 6 shows the tones generated when the tongues 22 were struck sequentially. In this instance, the sequence was 1, 2, 3, 4, 5, and 6, producing, respectively, notes F4, G4, A4, C5, D5, and F5. The rim of the bell was held to keep it from vibrating and showing up on the graph. Each tongue, when struck, generated a separate note. Evidence of paragraph [0023] can be seen as well.

FIG. 7 is a graph showing the sounds generated when the side of the bell 12 is struck with a mallet, and the tongues 22 are allowed to vibrate without them being struck. The sounds were picked up by a microphone, and analyzed with the software program indicated above. Thus, it is clearly evident that the tuned harmonic bell musical instrument of this invention enables bell like sounds to be obtained with harmonic overtones due to the tongues cut into the top of the dome of the bell.

An optional feature of the bell of the invention is the provision of a plurality of rubber cushions 26 placed on the top of the dome 18, surrounding the orifice 20. See FIG. 1. The purpose of the cushions 26 is to enable the bell to be inverted, as in FIG. 4, thus permitting the dome 18 to rest on the rubber cushions 26, which are now on the bottom. Thus, the bell can be used as a "singing bowl", if desired. The rubber cushions 26 allow the bell to ring freely. Without cushions the bell would be dampened when set upon a hard surface. Preferably, three rubber cushions 26 are used, but, any number can actually be used. What is required is that the dome 18 be able to rest on a flat surface when inverted, thus at least three cushions 26 spaced around the orifice 20 are required.

The second component of the musical instrument of this invention is a pedestal support structure 28 shown in FIGS. 1 and 3. The support structure 28 comprises a truncated trapezoidal shaped stand or pedestal 30 having a semi-circular depression 32 in the top thereof. The depression 32 is adapted to receive a rubber ball 34 when placed thereon. The rubber ball 34 has a string 36 attached to it, for the option of hanging the bell without a pedestal support. The pedestal 30 and the ball 34, together, are taller than the depth of the bell 12.

When it is desired to have the bell 12 free standing, it is seated on the rubber ball 34 situated on the trapezoidal pedestal 30. That is, the hole 20 in the top of the dome 18 is positioned over and aligned with the rubber ball 34. The hole 20 in the top of the dome 18 has a diameter slightly less that the diameter of the rubber ball 34, therefor when the dome 18 of the bell 12 is seated on the rubber ball 34, the ball provides a cushion upon which the dome 18 of the bell rests. This allows the tones of the bell to be freely projected, and clearly heard, without being muffled.

Figure 4:
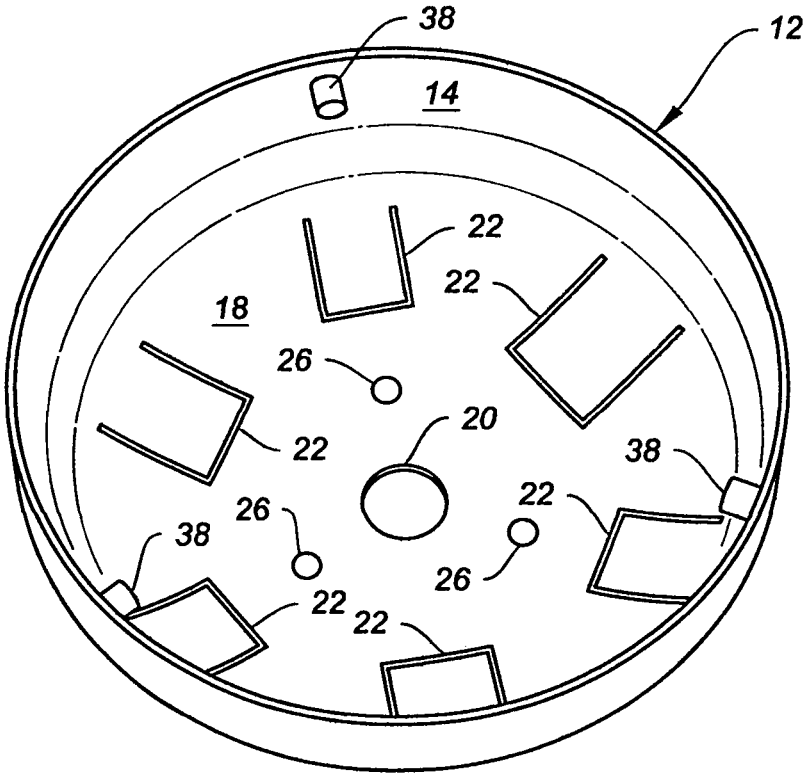
FIG. 4 is a perspective view from the bottom of the musical instrument of this invention

An additional optional feature of the musical instrument of this invention, as seen in FIG. 4. is the provision of weights 38 which can be attached to the underside of the bell 12. The weights 38 are used to finely tune the bell tone of the musical instrument 10. Adding weight to the bell lowers the pitch.

The unique tone of the harmonic bell of this invention is created in part by a tuned vibrating tongue of steel. The concept is similar to a wooden tongue drum. When a tongue is quickly and lightly struck with the finger or mallet it vibrates creating sound waves. By changing the shape and length of the tongue optimal vibration and perfect tone is achieved. By arranging the notes in a unique way each note when struck excites surrounding notes that are musically compatible with it. This adds to the harmonic spectrum of the tone. Rather than just one tone a spectrum of supporting sound for each note is created. The tone is similar to singing bowls or musical bells which create multiple harmonic overtones. The body of the bell acts as a resonating chamber and rings in its own note. The open bottom of the bell allows the sound to escape and increases the volume. It releases the tone from the body so that the notes do not overlap each other too much. This is especially desirable for faster playing.

A wide range of sounds can be created with different techniques. Playing by hand connects one with the bell in the way that traditional drums are enjoyed. A minimal amount of force creates a big sound on the bells. Mallets can also be used that are designed to bring out the pure sound of each note. The arrangement of the notes make going up and down the scale very easy. Also one hand can reach two or three notes simultaneously for chord playing.

The note layout as described herein adds harmonic tones to each note when played. This creates a more complex and musical tone to each tongue. By placing tongues generating low notes next to the tongues generating appropriate higher notes multiple harmonics are achieved. Their vibrations create desirable overtones which compliment the timbre of the tone. A true rectangular shape rather than the usual "Tongue" shape of a tongue produces a clearer sound. By using an ideal height to width ratio for different tongues, we have been able to improve the amplitude of the note and create better balance. Each tongue is sculpted into shape using a computer controlled cutter. This provides perfectly clean cuts and accuracy on every bell.

Powder coating can be applied to the outside and inside of the bell for a super durable and attractive finish.

The tuned harmonic bell comes in the key of F major pentatonic, however, other scales can be used such as F# minor, G major, G minor, A major, A minor, C Major, and in the custom Akebono scales in the keys of F, G, A and C. Many other scales, pentatonic or not are possible.

A Pentatonic scale is used which allow players with or without a musical background to be able to play any note combination and still produce a beautiful sound. One can choose from the Major or Minor scales for each bell, or choose a Custom Scale in Akebono, Pygmy or Integral Scale. The Major Scales produce a happy carefree sound and goes well with a variety of musical instruments. The Minor Scales produce a more soulful introspective sound, but like the major scales, they can be played in a variety of styles, from melancholy to very lively. The Akebono scale is a Japanese scale, and works very well for those who want a more meditative or exotic sound, and it also goes well with western and eastern sounding instruments. The Pygmy scale has a charm all of its own, and is a scale from Rwanda and in western context, it is a five note version of the Dorian mode.

While the present invention has been described in detail herein, and pictorially in the accompanying drawings, it is not limited to such details since any changes and modifications recognizable to those of ordinary skill in the art may be made to the invention without departing from the spirit and the scope thereof.

What is claimed is:

1. A tuned harmonic bell musical instrument comprising a circular base, open at the bottom, said base comprising a thin continuous vertical wall with the ends of the wall being joined together, thereby having a tube like configuration, a dome overlying said base and connecting to the top of said circular wall, being contiguous therewith, thereby forming a bell, said dome having an orifice in the center thereof, and a plurality of tongues in said dome, said tongues being positioned in the same surface plane as said dome, free on three sides and contiguous with said dome on the fourth side.

2. The musical instrument of claim 1 wherein said tongues are of varying surface area and vibrate when struck, each generating a specific musical note.

3. The musical instrument of claim 1 wherein said dome has six tongues of varying cross sectional area defined therein.

4. The musical instrument of claim 1 wherein said vertical wall of said base and said dome are formed from a continuous sheet of low carbon steel.

5. The musical instrument of claim 1 wherein the free ends of said tongues are oriented toward the orifice in the center of said dome, and the opposite ends of said tongues are adjacent the outer edge of said dome.

6. The musical instrument of claim 1 wherein said tongues are rectangular in configuration.

7. The musical instrument of claim 1 further comprising a support unit for said bell enabling said bell to be free standing.

8. The musical instrument of claim 7 wherein said support unit comprises a truncated trapezoidal base having a semi-circular circular depression in the top thereof, and a malleable ball positioned in said semi-circular depression.

9. The musical instrument of claim 8 wherein said malleable ball is rubber, and has a diameter larger than the diameter of said orifice in said bell.

10. The musical instrument of claim 8 wherein the height of said support unit is greater than the height of said bell, whereby when said bell is positioned on said support unit it is free standing and is connected to the environment solely through said rubber ball.

11. The musical instrument of claim 1 wherein said tongues are tuned to a pentatonic scale.

12. The musical instrument of claim 1 wherein said dome had a plurality of rubber cushions positioned around said orifice.

13. The musical instrument of claim 12 wherein the number of said rubber cushions is three, spaced equally around the orifice.

14. A tuned harmonic bell comprising a unitary object having a tubular base and a dome overlying and connected to said base, said base being open at the bottom thereof, and said dome having a plurality of tongues defined therein, said tongues being in the same plane as said dome, and being free on three sides.

15. A tuned harmonic bell musical instrument comprising a unitary tuned harmonic bell having a thin walled circular tubular base, open at the bottom thereof, and a dome overlying and connecting to said walls at the top edges thereof, the walls of said base and said dome being 2 mm thick, said dome having a series of six tongues cut therein, said tongues being free on three sides and connecting to said dome on the fourth side, each of said tongues being of separate cross sectional area, and generating a tone separate and distinct from the others, said tongues being arranged in sequence around the periphery of said dome, and being of sufficient cross sectional area as to generate in sequence tones F4, G4, A4, C5, D5, and F6.

* * * * *